US005576697A

United States Patent [19]

Nagashima et al.

[11] Patent Number: 5,576,697

[45] Date of Patent: Nov. 19, 1996

[54] FIRE ALARM SYSTEM

[75] Inventors: Tetsuya Nagashima, Sagamihara; Masato Aizawa, Hachiouji, both of Japan

[73] Assignee: Hochiki Kabushiki Kaisha, Tokyo, Japan

[21] Appl. No.: 229,613

[22] Filed: Apr. 19, 1994

[30] Foreign Application Priority Data

Apr. 30, 1993 [JP] Japan ..... 5-103369

[51] Int. Cl.[6] ..... G08B 17/107

[52] U.S. Cl. ..... 340/630; 340/693; 250/574; 356/336; 356/438

[58] Field of Search ..... 340/628, 630, 340/693; 250/573, 574 R, 579; 356/237, 336 R, 337, 338, 369, 438 R

[56] References Cited

U.S. PATENT DOCUMENTS

| | | | |
|---|---|---|---|
| 3,901,602 | 8/1975 | Gravatt, Jr. | 250/574 |
| 4,679,939 | 7/1987 | Curry et al. | 356/336 |
| 4,999,512 | 3/1991 | Zito | 250/574 |
| 5,104,221 | 4/1992 | Bott et al. | 356/336 |
| 5,280,272 | 1/1994 | Nagashima et al. | 340/630 |

*Primary Examiner*—Jeffery Hofsass
*Assistant Examiner*—Daniel J. Wu
*Attorney, Agent, or Firm*—Lackenbach Siegel Marzullo Aronson & Greenspan, P.C.

[57] ABSTRACT

A fire alarm system comprises a first light emitting device (11), a first polarizing filter (31), a first light receiving device (21), a second light emitting device (12), a second polarizing filter (32), and a second light receiving device (22). With the above arrangement, the amount of the parallel polarized component to the scattering plane as well as the amount of the perpendicular polarized component to the scattering plane is detected. The ratio between these amounts of light has a correlation with the type of smoke. A calculation section (4) calculates this ratio from the outputs of the light receiving devices (21, 22). A decision section (6) compares the above-described ratio with a reference value which has been preset according to the type of smoke to be detected, whereby the judgement of whether there is a fire or not is performed depending on the type of smoke. Thus, the detection of a fire can be performed from the light scattered by smoke taking into account the type of smoke.

14 Claims, 9 Drawing Sheets

FIRE ALARM SYSTEM

BACKGROUND OF THE INVENTION

1. Field of the Invention

The present invention relates to a fire alarm system of the light scattering type for detecting an occurrence of a fire from the light scattered by smoke arising from the fire. More specifically, the present invention relates to a fire alarm system which can perform appropriate detection of a fire depending on the type of smoke, according to the relationship between the type of smoke and the scattering angle as well as the degree of polarization of the scattered light. Especially, the present invention relates to a fire alarm system which uses a plane-polarized light source for emitting the light polarized in a predetermined direction so as to achieve accurate and reliable detection of a fire.

2. Description of the Related Art

FIG. 10 illustrates a conventional fire alarm system of the light scattering type, in which a light emitting device 102 such as a light emitting diode is disposed in such a manner that the light emitting device 102 is directed to the center portion X of a smoke detection chamber (smoke detection space). A light receiving device 104 such as a photodiode is disposed in such a manner chat the optical axis of the light receiving device 104 and the optical axis of the light emitting device 102 cross each other at a predetermined angle θ. The smoke detection space is always illuminated with the light emitted by the light emitting device 102 which has the directivity in the direction along its optical axis. If a fire occurs and smoke enters the smoke detection space, the light will be scattered by the smoke in the smoke detection space, and the scattered light will be detected by the light receiving device 104 via a converging lens (not shown).

When there is no fire in a normal situation, there is no smoke in the smoke detection space, and thus the intensity of the scattered light detected by the light receiving device 104 is low. On the other hand, if a fire occurs and smoke enters the smoke detection space, the intensity of the scattered light detected by the light receiving device 104 becomes high. There is a correlation between the density of smoke and the intensity of the scattered light which is incident on the light receiving device 104. Therefore, if the output level of the light receiving device 104 exceeds a predetermined threshold level, it is possible to conclude that there is a fire occurring.

However, in conventional fire alarm systems of the type described above, no decision on the smoke type is made, and the occurrence of a fire is detected merely from the density of smoke 106 in the smoke detection space. Therefore, such a conventional fire alarm system has a disadvantage that it cannot perform appropriated detection of a fire depending on the type of smoke.

The color of smoke and the diameters of smoke particles actually vary depending on the material on fire, such as plastic and wood. As a result, even in the case where there is no difference in the density of the smoke 106 in the smoke detection space, the difference in the intensity of the scattered light received by the light receiving device 104 can vary depending on the type of a material which is on fire. Therefore, if the occurrence of a fire is judged based on a constant threshold level neglecting the smoke type, a fire may be misdetected when there is no fire in reality, or otherwise a delay in the fire detection may occur. For example, if a room is filled with smoke of cigarettes, misdetection of a fire may occur when there is no fire in reality. In the case where oil is on fire, the intensity of the light scattered by the black smoke generated during the fire of oil is so low than the fire can be detected only after the fire has been expanded in a certain degree, and thus the fire detection will be delayed.

Some techniques have been proposed to try to solve the above problems. For example, in the technique disclosed in Japanese Patent Application Laid-Open No. 2-213997(1990), nonpolarized light is emitted by a light source, and the components of the scattered light polarized in two directions perpendicular to each other are separately detected. In this technique, the decision of the occurrence of a fire will be made when the ratio between the two components of the light comes in a certain predetermined range.

However, this technique neglects the fact that smoke is a mixture of a large number of particles having various diameters, and the fire detection is done by assuming all smoke particles have the same unique size. As a result, a detection error occurs for actual smoke. Furthermore, this technique uses a light source which emits nonpolarized light, and thus the polarization plane of the light source is not taken at all into consideration. As a result, a reduction occurs in the signal-to-noise ratio of the light received by the light receiving device for components of both polarization directions, and thus the output ratio actually obtained at the light receiving device 104 is not large enough for practical usage. In another technique disclosed in Japanese Patent Application Laid-Open No. 5-128381(1993), it is tried to improve the detection reliability by taking into account the smoke. In this technique disclosed in Japanese Patent Application Laid-Open No. 5-128381(1993), the intensities of the components of the light polarized in different directions are determined, and the degree of polarization is calculated from these intensities. Then, the type of smoke is determined from the result of the calculated degree of polarization. The judgement of occurrence of a fire is made by comparing the light intensity with a preset threshold value depending on the type of smoke. Even in this technique, as in the previous technique described above, the signal-to-noise ratio of the received light is low because this technique also uses a light source which emits nonpolarized light. The output ratio between the case where a fires occurs and the case where no fire occurs is about $2\times10^{-1}:4\times10^{-1}$, which is not large enough for a practical application.

SUMMARY OF THE INVENTION

In view of the above problems, it is an object of the present invention to provide a fire alarm system which can perform appropriate detection of a fire depending on the type of smoke by taking into account the polarization dependence of the scattered light on the size of smoke particles.

To achieve the above object, the present invention provides a fire alarm system comprising light emitting means for illuminating a smoke detection space, and light receiving means for receiving the light scattered by smoke wherein the occurrence of a fire is detected by comparing the amount of the light received by the light receiving means tea predetermined reference value, wherein the fire alarm system is characterized in that: the light emitting means emits plane-polarized light which is polarized parallel to a scattering plane as well as plane-polarized light which is polarized perpendicular to the scattering plane wherein the scattering plane is defined by the optical axis of the light emitting mean and the axis of the light receiving means wherein both axes cross each other at a point in the smoke detection space; and the light receiving means receives light which is parallel polarized component to the scattering plane and light which is perpendicular polarized component to the scattering plane; and the fire alarm system further comprises: photoelectric conversion means for detecting the amount of each polarized light received by the light receiving means; calculation means for calculating the ratio of the amount of the parallel polarized component to the scattering plane to that perpendicular polarized component to the scattering plane wherein the amount of the light polarized in each direction is obtained by the photoelectric conversion means; and decision means which compares the ratio obtained by the calculation means to a reference valise preset for each type of smoke whereby the judgement of whether there is a fire or not is performed based on the reference value for each type of smoke.

In this system, there is a correlation between the type of smoke and the ratio of the amount of the received parallel polarized component to the scattering plane to the amount of the received perpendicular polarized component to the scattering plane. Therefore, in this system according to the present invention, the ratio of the amount of the received parallel polarized component to the scattering plane to the amount of the received perpendicular polarized component to the scattering plane is compared to a reference value preset depending on the type of smoke to be detected, and judgement of whether there is a fire or not is performed depending on the type of the smoke. In this way, the present invention provides a fire alarm system of the light scattering type which can appropriate detection of a fire depending on the type of smoke.

In a preferable aspect of the present invention, the light emitting means comprises a first and second light emitting devices, and the light receiving means comprises a first and second light receiving devices, wherein the first light emitting device emits plane-polarized light which is polarized parallel to a first scattering plane in which the first scattering plane is defined by the optical axis of the first light emitting device and the axis of the first light receiving device wherein both axes cross each other at a point in the smoke detection space, the second light emitting device emits plane-polarized light which is polarized perpendicular to a second scattering plane in which the second scattering plane is defined in the smoke detecting space by the optical axis of the second light emitting device and the axis of the second light receiving device wherein both axes cross each other in the smoke detection space, the first light receiving device receives parallel polarized component to the first scattering plane, the second light receiving device receives perpendicular polarized component to the second scattering plane, the photoelectric conversion means detects the amounts of the light received by the first and second light receiving devices, and the calculation means calculates the ratio of the amount of the light received by the first light receiving device to that received by the second light receiving device wherein each amount of the light is obtained by the photoelectric conversion means.

In another aspect of the present invention, the light receiving means comprises a first light receiving device and a second light receiving device; the light emitting means emits plane-polarized light which is polarized parallel to a first scattering plane wherein the first scattering plane is defined by the optical axis of the light emitting means and the axis of the first light receiving device wherein both axes cross each other at a point in the smoke detection space; the first light receiving device receives parallel polarized component to the first scattering plane; the second light receiving device receives perpendicular polarized component to a second scattering plane wherein the second scattering plane is defined by the optical axis of the light emitting means and the axis of the second light receiving device wherein both axes cross each other at a point in the smoke detection space; said first scattering plane is perpendicular to said second scattering plane; the photoelectric conversion means detects the amounts of the light received by the first and second light receiving devices; and the calculation means calculates the ratio of the amount of the light received by the first light receiving device to that received by the second light receiving device wherein each amount of the light is obtained by the photoelectric conversion means.

In still another aspect of the present invention, the light emitting means comprises a first light emitting device and a second light emitting device which are lit alternately; the first light emitting device emits plane-polarized light which is polarized parallel to a first scattering plane wherein the first scattering plane is defined by the optical axis of the first light emitting device and the axis of the light receiving means wherein both axes cross each other at a point in the smoke detection space; the second light emitting device emits plane-polarized light which is polarized perpendicular to a second scattering plane wherein the second scattering plane is defined by the optical axis of the second light emitting device and the axis of the light receiving means wherein both axes cross each other at a point in the smoke detection space; the light receiving means receives parallel polarized component to the first scattering plane; said first scattering plane is perpendicular to said second scattering plane; the photoelectric conversion means detect the amounts of the light received by the light receiving means when the first or second light emitting device is lit; and the calculation means calculates the ratio of the amount of the light received when the first light emitting device is lit to the amount of the light received when the second light emitting device is lit wherein each amount of the light is obtained by the photoelectric conversion means.

In another aspect of the present invention, the light emitting means emits plane-polarized light, and the fire alarm system further comprises: driving means for rotating the light emitting means such that the polarization plane of plane-polarized light emitted by the light emitting means becomes parallel or perpendicular to the above-described scattering plane; and a polarizing filter disposed in front of the light receiving means in which the polarizing filter is rotated in synchronization with the light emitting means such that the polarizing filter may be at the position at which only the light which is polarized in the same plane as that of the above-described plane-polarized light can pass through the polarizing filter; wherein the photoelectric conversion means detects the amount of the light received by the light receiving means when the light emitting means comes at positions at which the polarization direction of the plane-polarized light emitted by the light emitting means becomes perpendicular or parallel to the scattering plane, and the calculation means calculates the ratio of the amount of the light received when the polarization plane of the plane-polarized light becomes perpendicular to the scattering plane to the amount of the light received when the polarization plane of the plane-polarized light becomes parallel to the scattering plane wherein the amount of the light is obtained by the photoelectric conversion means.

To achieve the above-described object, the present invention also provides a method of detecting a fire by using light emitting means for illuminating a smoke detection space, and light receiving means for receiving light scattered by smoke wherein the occurrence of a fire is detected by comparing the amount of light received by the light receiving means to a predetermined reference value, the method comprising the steps of: emitting, from the light emitting means, the plane-polarized light which is polarized parallel to a scattering plane as well as plane-polarized light which is polarized perpendicular to the scattering plane wherein the scattering plane is defined by the optical axis of the light emitting mean and the axis of the light receiving means wherein both axes cross each other at a point in the smoke detection space; receiving, with the light receiving means, light which is polarized parallel to the scattering plane as well as light which is polarized perpendicular to the scattering plane; detecting the amount of each plane-polarized light received by the light receiving means; calculating the ratio of the amount of the parallel polarized component to the scattering plane to the amount of the perpendicular polarized component to the scattering plane; and comparing the ratio to a reference value preset for each type of smoke whereby the judgement of whether There is a fire or not is performed based on the reference value for each type of smoke.

In a preferable aspect of the method of detecting a fire according to the present invention, the light emitting means comprises a first light emitting device and a second light emitting device; and the light receiving means comprises a first light receiving device and a second light receiving device; the method comprises the steps of: emitting, from the first light emitting device, plane-polarized light which is polarized parallel to a first scattering plane wherein the first scattering plane is defined by the optical axis of the first light emitting device and the axis of the first light receiving device wherein both axes cross each other at a point in the smoke detection space; emitting, from the second light emitting means, plane-polarized light which is polarized perpendicular to a second scattering plane wherein the second scattering plane is defined by the optical axis of the second light emitting device and the axis of the second light receiving device wherein both axes cross each other at a point in the smoke detection space; receiving parallel polarized component to the first scattering plane by using the first light receiving device; receiving perpendicular polarized component to the second scattering plane by using the second light receiving device; detecting the amount of each plane-polarized light received by The first and second light receiving devices; calculating the ratio of the amount of the light received by the light receiving device to that received by the second light receiving device; and comparing the ratio to a reference value preset for each type of smoke whereby the judgement of whether there is a fire or not is performed based on the reference value for each type of smoke.

In another aspect of the method of detecting a fire according to the present invention, the light emitting means comprises a first light emitting device and a second light emitting device; and the method comprises the steps of: emitting, from the light emitting means, plane-polarized light which is polarized parallel to a first scattering plane wherein the first scattering plane is defined by the optical axis of the light emitting means and the axis of the first light receiving device wherein both axes cross each other at a point in the smoke detection space; receiving parallel polarized component to the first scattering plane by using the first light receiving device; receiving, with the second light receiving device, perpendicular polarized component to a second scattering plane wherein the second scattering plane is defined by the optical axis of the light emitting means and the axis of the second light receiving device wherein both axes cross each other at a point in the smoke detection space; said first scattering plane is perpendicular to said second scattering plane; detecting the amount of each plane-polarized light received by the first and second light receiving devices; calculating the ratio of the amount of the light received by the first light receiving device to that received by the second light receiving device; and comparing the ratio to a reference value preset for each type of smoke whereby the judgement of whether there is a fire or not is performed based on the reference value for each type of smoke.

In still another aspect of the method of detecting a fire according to the present invention, the light emitting means comprises a first light emitting device and a second light emitting device which are lit alternately; the method comprising the steps of: emitting, from the first light emitting device, plane-polarized light which is polarized parallel to a first scattering plane wherein the first scattering plane is defined by the optical axis of the first light emitting device and the axis of the light receiving means wherein both axes cross each other at a point in the smoke detection space; emitting, from the second light emitting device, plane-polarized light which is polarized perpendicular to a second scattering plane wherein the second scattering plane is defined by the optical axis of the second light emitting device and the axis of the light receiving means wherein both axes cross each other at a point in the smoke detection space; receiving parallel polarized component to the first scattering plane by using the light receiving means; said first scattering plane is perpendicular to said second scattering plane; detecting the amount of the light received by the light receiving means when the first or second light emitting devices is lit; calculating the ratio of the amount of the light received when the first light emitting device is lit to that received when the second light emitting device is lit; and comparing the ratio to a reference value preset for each type of smoke whereby the judgement of whether there is a fire or not is performed based on the reference value for each type of smoke.

In another aspect of the present invention, a method of detecting a fire comprises the steps of: emitting plane-polarized light from the light emitting means; providing driving means for rotating the light emitting means such that the polarization plane of the plane-polarized light becomes parallel or perpendicular to the scattering plane; providing a polarizing filter disposed in front of the light receiving means wherein the polarizing filter is rotated in synchronization with the light emitting means such that the polarizing filter may be at the positions at which only the light which is polarized in the same plane as that of the plane-polarized light can pass through the polarizing filter; detecting the amount of the light received by the light receiving means when the light emitting means comes at a position at which the polarization plane of the plane-polarized light emitted by the light emitting means becomes perpendicular or parallel to the scattering plane; calculating the ratio of the amount of the light received when the polarization plane of the plane-polarized light becomes perpendicular to the scattering plane to that received when the polarization plane of said plane-polarized light becomes parallel to the scattering plane; and comparing the ratio to a reference value preset for each type of smoke whereby the judgement of whether there is a fire or not is performed based on the reference value for each type of smoke.

Furthermore, the scattering angle may be set to a angle in the range from 60° to 140°, more preferably, the scattering angle may be set to 90°, so as to make the above-described ratio greater. Thus, more reliable detection of a fire can be achieved.

DESCRIPTION OF THE PREFERRED EMBODIMENTS

Figure 1:
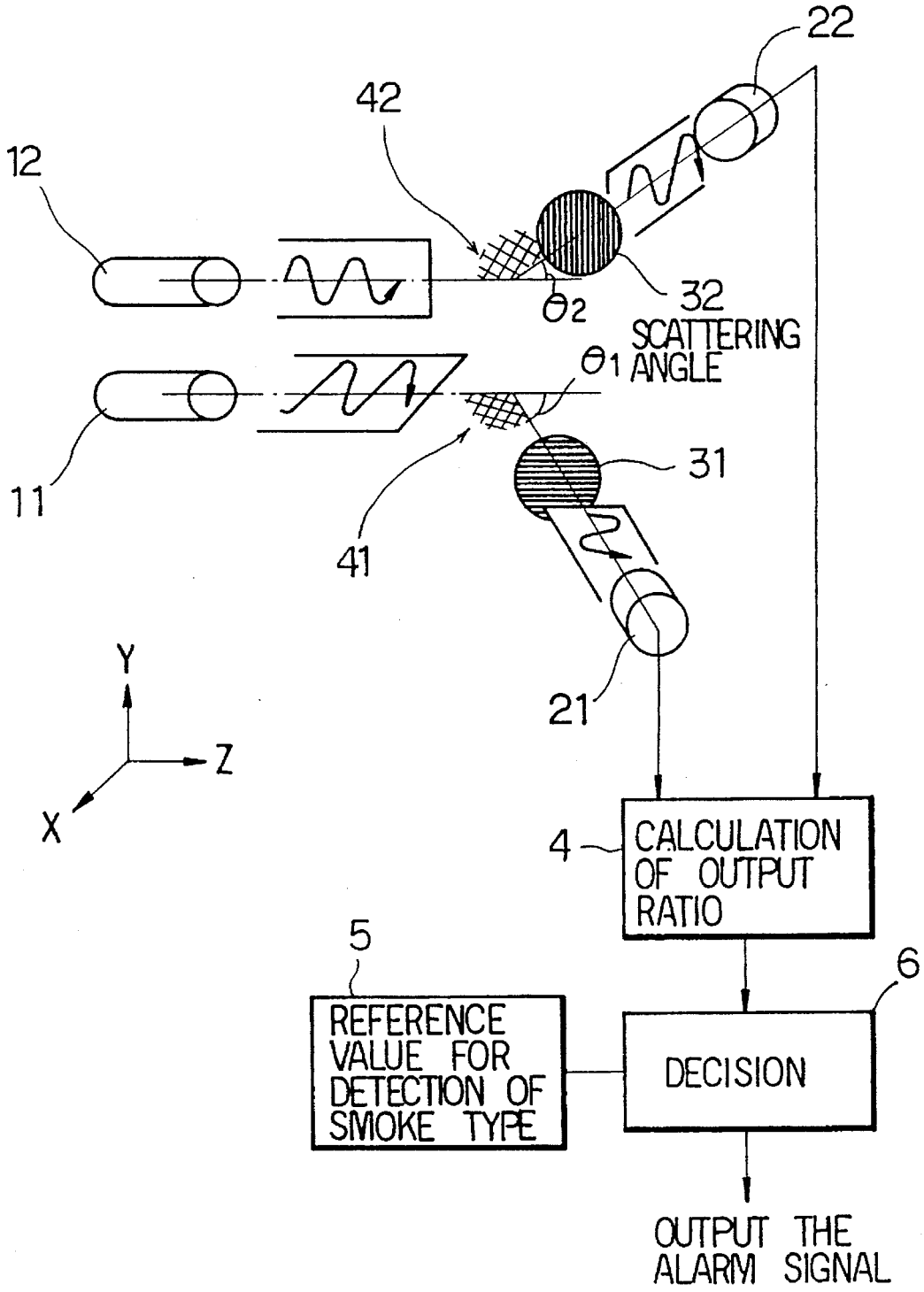
FIG. 1 is a schematic diagram illustrating an arrangement of a fire alarm system according to one embodiment of the present invention.

Referring to the accompanying drawings, exemplary embodiments of the present invention will be described hereinbelow. FIG. 1 is a schematic diagram illustrating an arrangement of a fire alarm system of the light scattering type according to one embodiment of the present invention, in which a smoke detection space is represented by the three-dimensional x, y, z-coordinate system.

As shown in FIG. 1, there are provided a first light emitting device 11 and a second light emitting device 12 each comprising for example a laser diode for emitting plane-polarized light. The first light emitting device 11 is disposed in such a manner that the polarization plane of the light emitted by the first light emitting device 11 is parallel to the first scattering plane 41 wherein the first scattering plane 41 is formed in the smoke detecting space by the optical axis of the first light emitting device and the axis of a first light receiving device 21. The second light emitting device 12 is disposed in such a manner that the polarization plane of the light emitted by the second light emitting device 12 is perpendicular to the second scattering plane 42 wherein the second scattering plane 42 is formed in the smoke detecting space by the optical axis of the second light emitting device and the axis of a second light receiving device 22. That is, in the example shown in FIG. 1, the first light emitting device 11 is disposed in such a manner that the polarization plane of the light emitted therefrom is parallel to the xz-plane, and the second light emitting device 12 is disposed in such a manner that the polarization plane of the light emitted therefrom is parallel to the yz-plane.

The light emitted by the first light emitting device 11 is scattered by a collection of smoke particles. The scattered light is received by the first light receiving device 21 via a first polarizing filter 31 wherein the first light receiving device 21 and the first polarizing filter 31 are disposed at an appropriate scattering angle $\theta_1$ relative to the optical axis of the first light emitting device 11 ($\theta_1$ is defined as an angle formed by the optical axis of the first light emitting device 11 and the optical axis of the first light receiving device 21, wherein the angle is formed at the side opposite to the first light emitting device 11. Other scattering angles are also defined in a similar manner.) The light emitted by the second light emitting device 12 is also scattered by a collection of smoke particles, and is received by the second light receiving device 22 via a second polarizing filter 32 wherein the second light receiving device 22 and the second polarizing filter 32 are disposed at an appropriate scattering angle $\theta_2$ relative to the optical axis of the second light emitting device 12. The first polarizing filter 31 is disposed in such a manner that its polarizing plane is parallel to the first scattering plane 41 (the xz-plane) formed by the first light emitting device 11 and the first light receiving device 21. The second polarizing filter 32 is disposed in such a manner that its polarizing plane is perpendicular to the second scattering plane 42 (the yz-plane).

The ratio of the output of the first light receiving device 21 to the output of the second light receiving device 22 is calculated by a calculation section 4. A reference setting section 5 includes a reference value of the ratio of the output of the first light receiving device 21 to the output of the second light receiving device 22 wherein the reference value is preset depending on the type of smoke to be detected. A decision section 6 makes comparison between the reference value preset in the reference setting section 5 and the ratio of the output of the first light receiving device 21 to the output of the second light receiving device 22, and then judges whether there is a fire, taking into account the type of smoke.

If smoke enters the space which includes a point at which the optical axis of the first light emitting device 11 and the optical axis of the first light receiving device 21 cross each other, and a point at which the optical axis of the second light emitting device 12 and the optical axis of the second light receiving device 22 also cross each other, both light beams emitted by the first and the second light emitting devices 11 and 12 are scattered by a collection of smoke particles. Then, the scattered light comes to the first and the second light receiving devices 21 and 22, and thus the first and the second light receiving devices 21 and 22 generate the corresponding signals. According to the investigation of the inventor of the present invention, there is specific relationships between the outputs of the first and the second light receiving devices 21 and 22, which characterize the types of smoke.

These relationships will be described in more detail below. It is known that the light scattered by the smoke particles or the like includes polarized components. The inventor of the present inventions performed simulation of the degree of polarization of the light scattered by smoke particles for various types of smoke. The simulation revealed that the magnitude of a polarized light component varies depending on the type of smoke.

According to the theoretical equation associated with the electric field (H. C. Van De Hulst, "Light Scattering by Small Particles"), the electric field ($\rightarrow$Eo) of plane-polarized light in the xz-plane shown in FIG. 1 can be written as $$E_0 = a_x \cdot e^{-ikz+i\omega t} \tag{1}$$

where ax is the complex amplitude of the electric field. In the present description, notation "$\rightarrow$" is used to denote a complex variable in such a manner as →E and →a. When the incident light described by the above equation is scattered by one particle, the scattered light components (→Er) and (→El) in the plane (l, r) lying at an angle (scattering angle) ø relative to the xz-plane can be written as $$E_r=-(i/kr)\cdot a_x\cdot e^{-ikz+i\omega t}\cdot S_1(\theta)\cdot\sin\Phi$$

$$E_l=-(i/kr)\cdot a_x\cdot e^{-ikz+i\omega t}\cdot S_2(\theta)\cdot\cos\Phi \quad (2)$$

where $(-S_1(\theta), -S_2(\theta))$ is the scattering function of a particle having a diameter "a" for the scattering angle θ.

The intensity I of the scattered light can be written as $$I=I_0F(\theta,\Phi)/(k^2r^2) \quad (3)$$

where k is the wave number ($k=2\pi/\lambda$), r is the distance from the particle, and the F (θ,Φ) is the scattering function described as follows:

$$F(\theta,\Phi) = i_2(\theta)\cos^2\Phi + i_1(\theta)\sin^2\Phi \quad (4)$$

$$i_1(\theta) = |S_1(\theta)|^2$$

$$i_2(\theta) = |S_2(\theta)|^2$$

Figure 2:
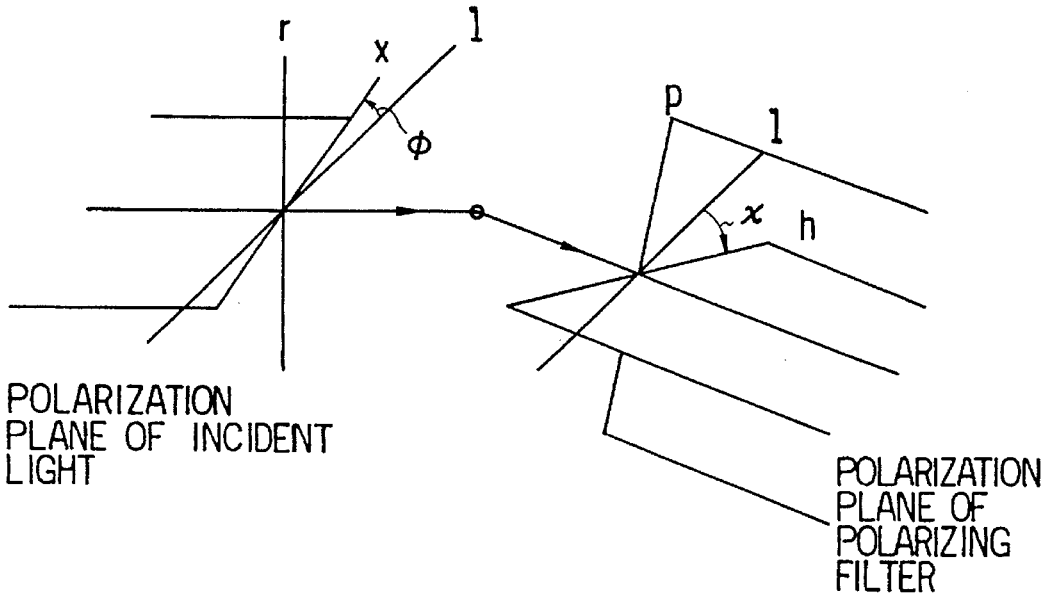
FIG. 2 is a schematic diagram illustrating relationships between the polarization plane of incident light and the polarization plane of a polarizing filter used in the arrangement shown in FIG. 1.

Let us discuss the scattered light as measured via a polarizing filter. Let us assume that the polarizing filter is disposed at an angle χ relative to the coordinate system (l, r) of the reference plane as shown in FIG. 2. If coordinate transformation is performed on the scattered light (→El, →Er) to obtain the representation by the coordinate system (h, p) in the plane χ, then the scattered light (→Eh, →Ep) can be described by $$E_h=E_l\cdot\cos\chi+E_r\cdot\sin\chi$$

$$E_p=E_r\cdot\cos\chi-E_l\cdot\sin\chi \quad (5)$$

Thus, $$E_h = -(i/kr)\cdot a_x\cdot e^{-ikz+i\omega t} *\{S_2(\theta)\cdot\cos\Phi\cdot\cos\chi + S_1(\theta)\cdot\sin\Phi\cdot\sin\chi\}$$

$$E_p = -(i/kr)\cdot a_x\cdot e^{-ikz+i\omega t} *\{S_1(\theta)\cdot\sin\Phi\cdot\cos\chi - S_2(\theta)\cdot\cos\Phi\cdot\sin\chi\}$$

Therefore, the intensities of the scatted light measured via the polarizing filter can be written as $$I_h(\theta)=|E_h(\theta)|^2$$

$$I_p(\theta)=|E_p(\theta)|^2 \quad (6)$$

The total amounts Iscah, Iscap of the light scattered by the entire layer of the smoke can be obtained by multiplying the intensities Ih, Ip of the scattered light for a diameter "a" by the number of particles Na, and further integrating this product with respect to the diameter of the particle for the entire range. Hence, we can obtain:

$$Isca_h=\int_0^\infty |E_h(\theta)|^2 * N_a\, da \quad (7)$$

-continued $$Isca_p=\int_0^\infty |E_p(\theta)|^2 * N_a\, da$$

Figure 3:
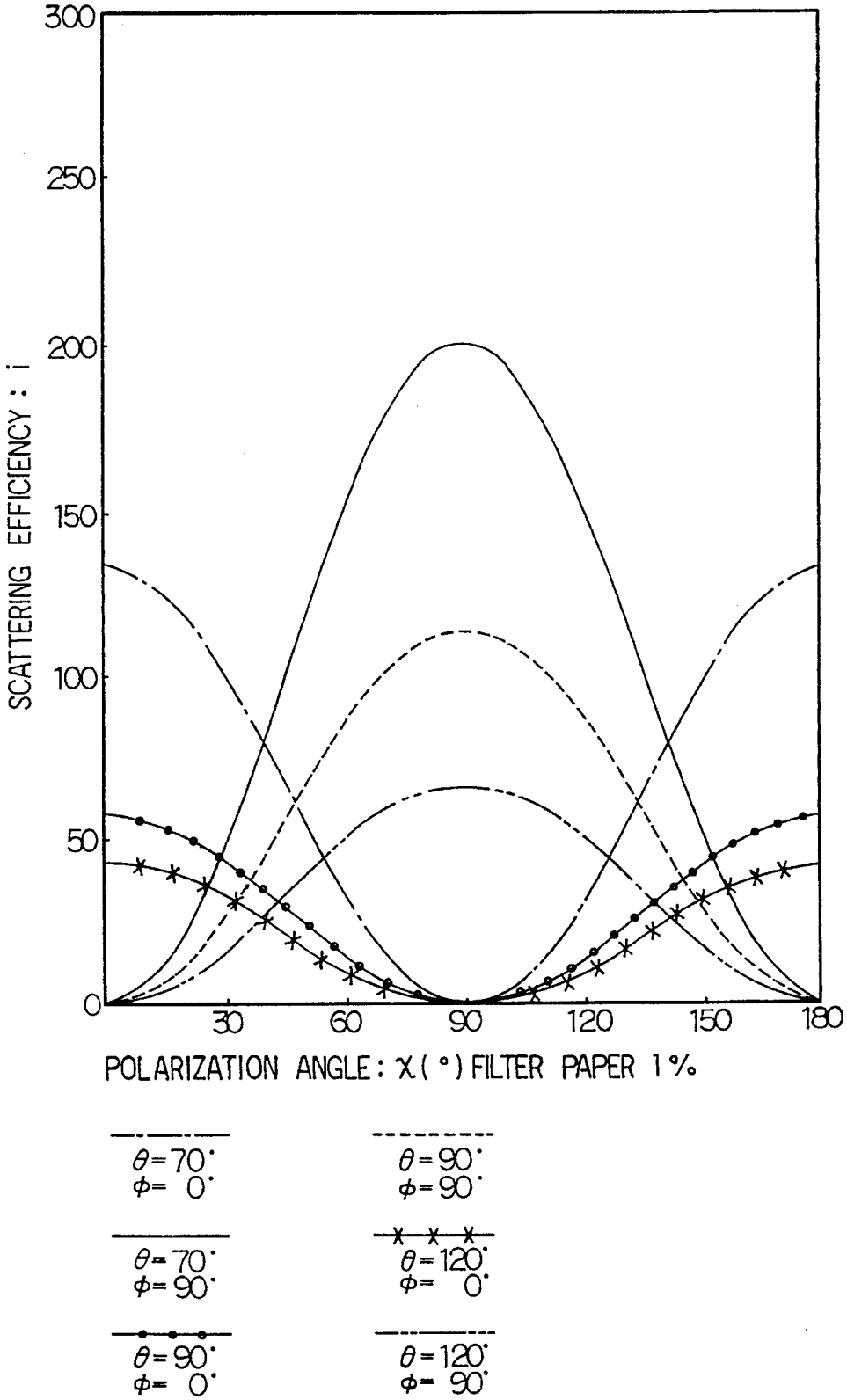
FIG. 3 is a graph illustrating the scattering efficiency of smoke arising from smoldering filter paper.
Figure 4:
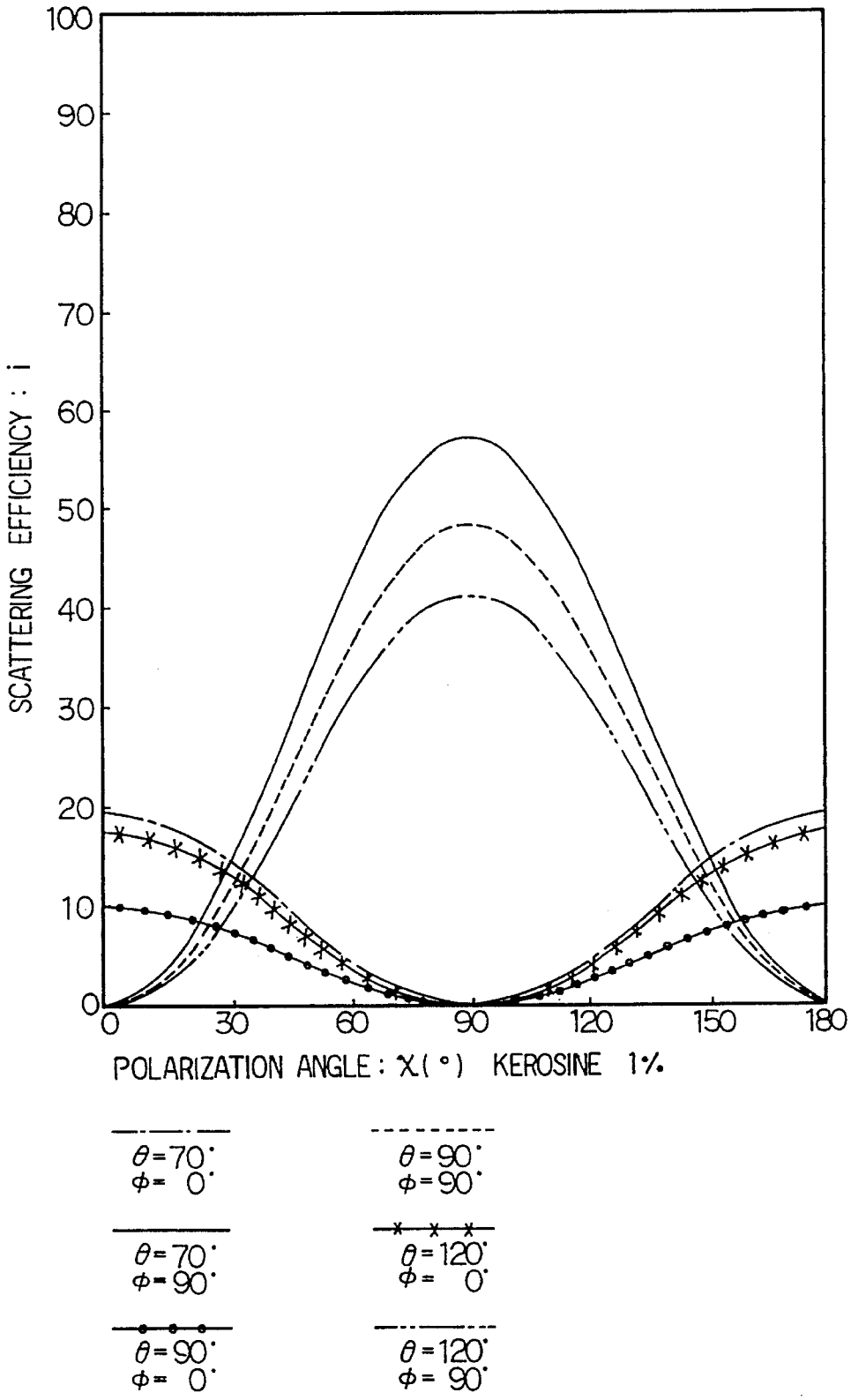
FIG. 4 is a graph showing the scattering efficiency of smoke arising from burning kerosine.
Figure 5:
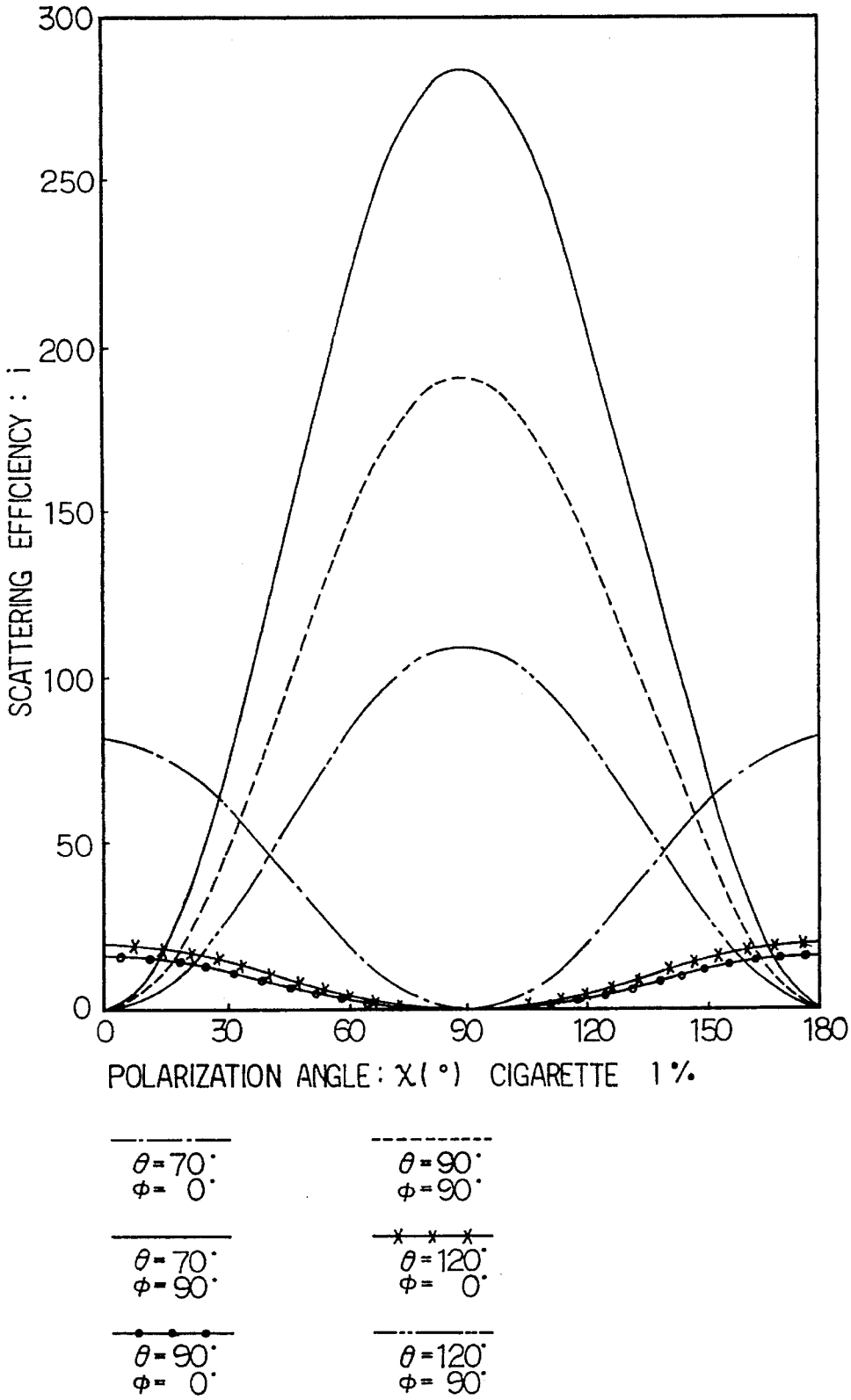
FIG. 5 is a graph showing the scattering efficiency of smoke arising from a cigarette.

According to the theoretical analysis described above, the polarization components are calculated for various types of smoke. The results are shown in FIGS. 3 through 5. FIG. 3 shows the scattering efficiency i of smoke arising from smoldering filter paper. Similarly, FIGS. 4 and 5 show the scattering efficiencies for the burning kerosine and for the smoke of cigarette, respectively. In these figures, the amount of scattered light is shown as a function of the angle of the polarizing filter for various type of smoke for both cases where the polarization angle of the incident light is 0° and 90°.

As can be seen from FIGS. 3–5, the amount of scattered light which can be received for each case becomes maximum when the angle of the polarizing filter coincides with the polarization plane of the incident light. That is, the receiving amount of the scattered light becomes maximum at χ=0 for ø=0, and at χ=90 for ø=90. Furthermore, as can also be seen from these figures, when the scattering angle is kept constant, the maximum receiving amount of the scattered light varies depending on the polarization angle ø.

Figure 6:
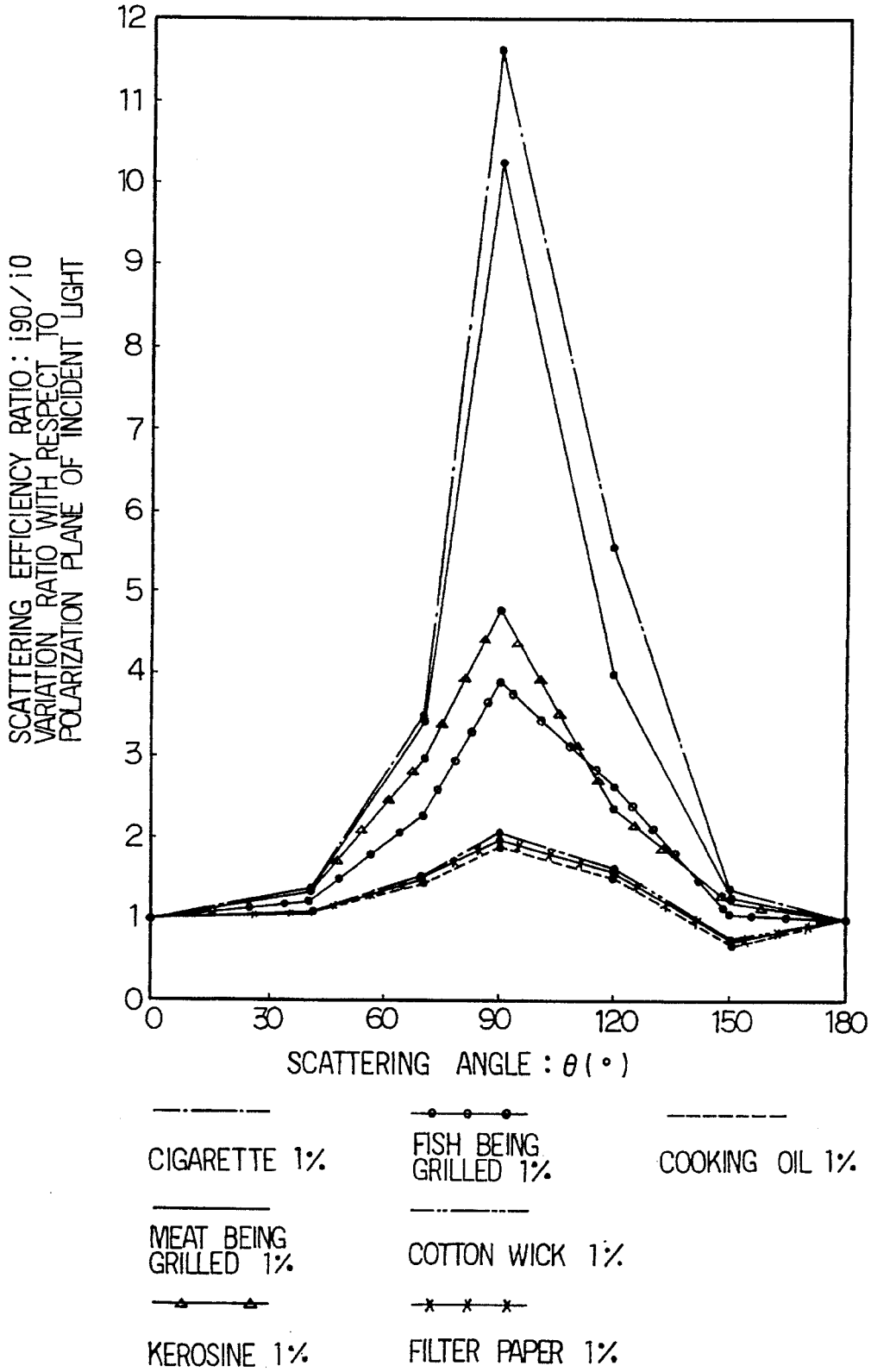
FIG. 6 is a graph showing parameters for distinguishing various types of smoke.

In FIG. 6, the ratio i90/i0, that is, the ratio of the maximum receiving amount of light for the polarization angle of 90° (ø=90°) to the maximum receiving amount of light for the polarization angle of 0°(ø=0°) is plotted for various types of smoke arising from various materials such as a cigarette, meat or fish being grilled, cooking oil, smoldering filter paper, a smoldering cotton wick, and kerosine. As can be seen from FIG. 6, the ratio i90/i0 has a maximum value when the scattering angle is equal to 90° for any type of smoke. Furthermore, the ratio i90/i0 can be used as a parameter for detecting the type of smoke.

This parameter (i90/0) for detecting the type of smoke is exactly the ratio of the output of the second light receiving device 22 to the output of the first light receiving device 21 (i90/i0=(the output of the second light receiving device 22)/(the output of the first light receiving device 21). Therefore, in a smoke detector of the light scattering type utilizing the smoke-type detection parameter (i90/i0) in which the scattering angle θ is set to 120°, if the smoke-type detection parameter (i90/i0) becomes greater than about 5, then it is possible to conclude that the detected smoke arises from a cigarette. If the smoke-type detection parameter is in the range from 2 to 3, then it is possible to conclude that the smoke arises from oil. If the parameter is less than 2, it is possible to conclude that the smoke arises from smoldering paper or the like.

The operation of the above smoke detector of the light scattering type will be described below. If the smoke detector is installed for the detection of an oil fire, a reference value of the smoke-type detection parameter (i90/i0) in the range from 2 to 3 is preset in the reference setting section 5. If the smoke detector is installed for the detection of smoking of paper or the like, a reference value of the smoke-type detection parameter (i90/i0) less than 2 is preset in the reference setting section 5. The ratio of the output of the second light receiving device 22 to that of the first light receiving device 21 is compared with the reference value by the decision section 6. If there is a good coincidence, then a fire alarm signal is output.

In this embodiment, as described above, the reference value of the smoke-type detection parameter corresponding to the polarization characteristics of smoke particles to be detected is preset in the reference setting section 5, and thus accurate detection of the occurrence of a fire can be performed regardless of the smoke density judging from the light scattered by smoke, taking into account the type of smoke. Thus, it is possible to avoid incorrect detection of smoke arising from something, such as a cigarette, other than a fire, and it is possible to detect only a real fire. Furthermore, it is possible to distinguish a fire which expands quickly such as an oil fire from a fire which expands slowly such as smoldering of paper, and thus it is possible to take an appropriate action to extinguish a fire or to lead people to a safe place, depending on the type of the fire.

Figure 7:
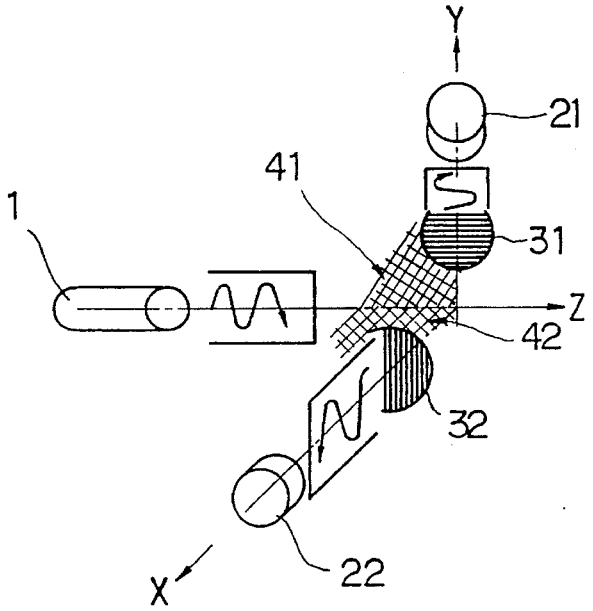
FIG. 7 is a schematic diagram illustrating an optical system used in a fire alarm system of a second embodiment according to the present invention.

Now, a second embodiment will be described below referring to FIG. 7. Although the system configuration of the second embodiment differs from that of the first embodiment, this embodiment also provides accurate detection of a fire in an appropriate manner depending on the type of smoke wherein the fire detection is performed using the relationships between the type of smoke and the scattering angle as well as the degree of polarization. FIG. 7 illustrates an example of a system configuration comprising one light source (light emitting device) 1, two light receiving devices 21 and 22, and two polarizing filters 31 and 32. The light source 1 is disposed such that its polarization plane is coincident with the yz-plane. The first light receiving device 21 and the first polarizing filter 31 are disposed along the y-axis. The first polarizing filter 31 is disposed such that its polarization plane is parallel to the yz-plane. The second light receiving device 22 and the second polarizing filter 32 are disposed along the x-axis. The second polarizing filter 32 is disposed such that its polarization plane is parallel to the xy-plane.

In this embodiment, as in the case of the previous embodiment, the light component having a polarization plane parallel to a first scattering plane 41 (that is, the yz-plane) can be detected via the first polarizing filter 31, and the light component having a polarization plane parallel to a second scattering plane 42 (that is, the xy-plane) can be detected via the second polarizing filter 32. Therefore, the type of smoke can be distinguished according to the output ratio i90/i0, that is, the ratio of the output of the second light receiving device 22 to the output of the first light receiving device 21.

This embodiment may be modified such that the first polarizing filter 31 may be rotated by for example a motor to realize the same state as that realized by the second polarizing filter 32. The polarization filter is stopped at both positions at which the polarization plane becomes coincident with the polarization plane of the first polarizing filter 31 or with the polarization plane of the second polarizing filter 32 so that the polarized light may be detected alternately at the above-mentioned positions to detect the type of smoke. In this case, there is no need to use the second polarizing filter 32. An arbitrary appropriate filter such as a liquid crystal filter can be used as the polarization filter.

Figure 8:
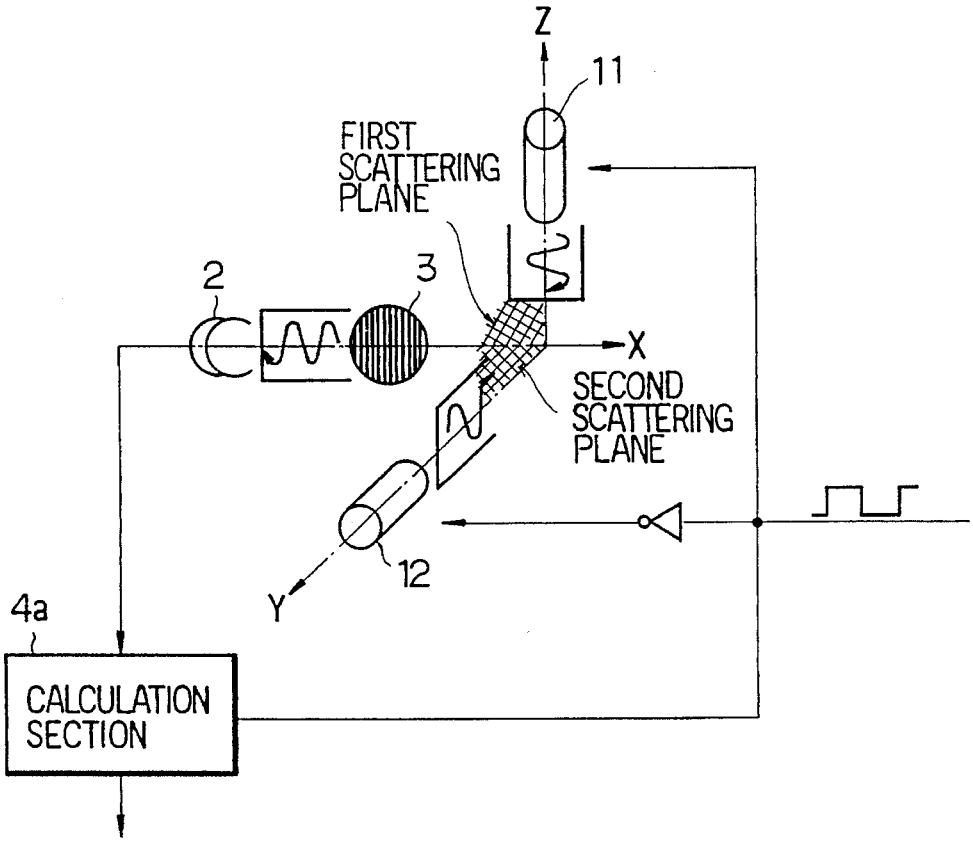
FIG. 8 is a schematic diagram illustrating major portions of a fire alarm system of a third embodiment according to the present invention.

FIG. 8 shows a third embodiment. In this embodiment, the system comprises two light sources 11 and 12, a light receiving device 2, and a polarizing filter 3. The polarizing filter 3 is disposed such that its polarization plane is parallel to the xz-plane. The first and the second light emitting devices 11 and 12 are disposed along the z-axis and the y-axis, respectively. The first light emitting device 11 is disposed such that its polarization plane is parallel to the xz-plane. The second light emitting device 12 is disposed such that its polarization plane is parallel to the yz-plane.

In this embodiment, only one light receiving device is used, and the first light emitting device 11 and the second light emitting device 12 are lit alternately. A calculation section 4*a* calculates the ratio i90/i0, that is, the ratio of the output of the light receiving device 2 obtained when the second light emitting device 12 is lit to that obtained when the first light emitting device 11 is lit so as to distinguish the type of smoke.

This embodiment may be modified such that the first light emitting device 11 may be rotated by for example a motor to obtain the same state of the polarization plane as that provided by the second light emitting device 12, and the light receiving device 2 may alternately receive the light polarized in different directions so as to distinguish the type of smoke.

Figure 9A:
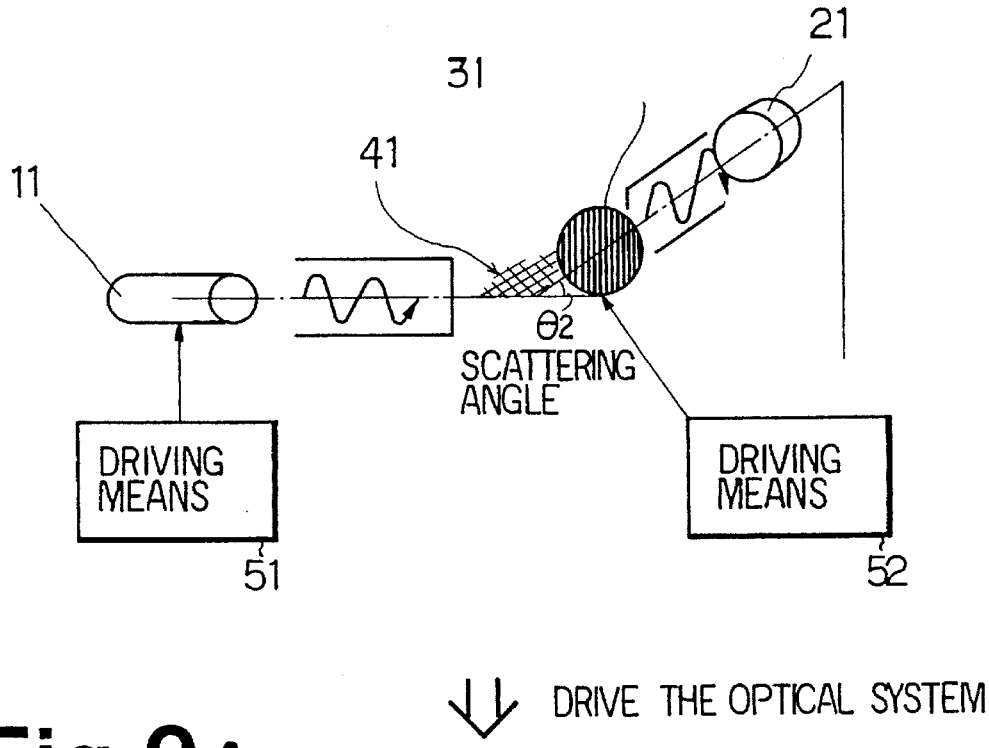
FIG. 9 is a schematic diagram illustrating an arrangement of a fire alarm system of a fourth embodiment according to the present invention.

FIG. 9 shows a fourth embodiment. In this embodiment, the system comprises a light emitting device 11, a light receiving device 21, a polarizing filter, and driving means 51 and 52 for rotating the light emitting device 11 and the polarizing filter 31. In this embodiment, the light emitting device 11 and the polarizing filter 31 are rotated in synchronization with each other so that the polarization direction of the light emitted by the light emitting device 11 may coincide with the polarization plane of the polarizing filter 31. As shown in FIG. 9(A), the light emitting device 11 is stopped first at the position at which the polarization plane of the light emitted by the light emitting device 11 becomes perpendicular to the scattering plane 41. At the same time, the polarizing filter 31 is stopped at the position at which its polarization plane becomes perpendicular to the scattering plane 41. In this state, the light receiving device 21 detects the scattered light.

Figure 9B:
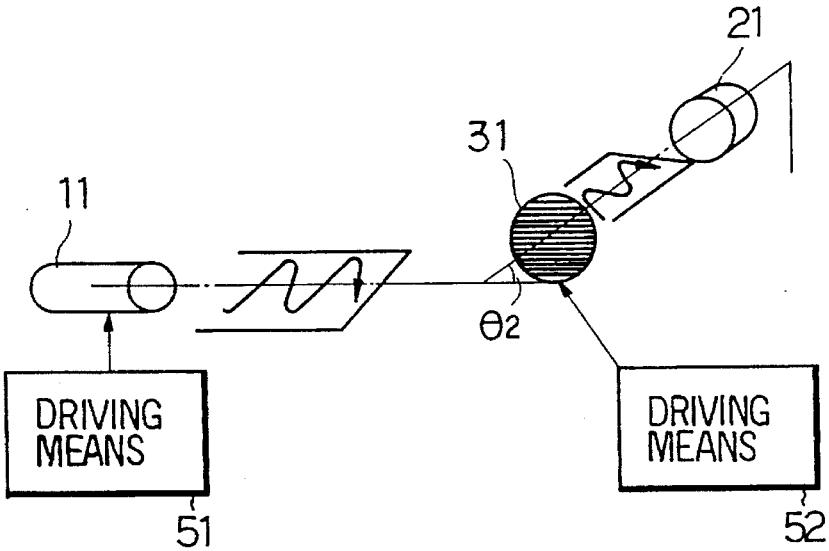
Figure 10:
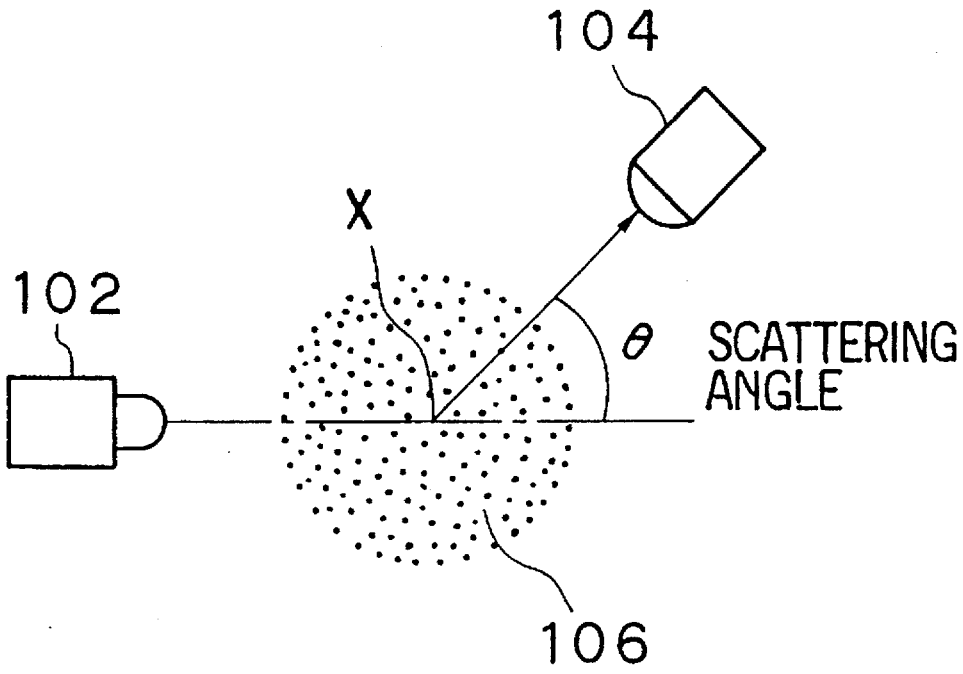
Fig.10 (PRIOR ART)
FIG. 10 is a schematic diagram illustrating major portions of a conventional fire alarm system of the light scattering type.

Then, as shown in FIG. 9(B), the driving means 51 rotates the light emitting device 11 to the position at which the polarization plane of the light emitted by the light emitting device 11 becomes parallel to the scattering plane 41. At the same time, the polarizing filter 31 is rotated to the position at which its polarizing plane becomes parallel to the scattering plane 41. In this state, the light receiving device 21 detects the scattered light. The ratio of the amount of the light detected in this state to that detected in the previous state is determined so as to distinguish the type of smoke. In this embodiment, only one light emitting device and one light receiving device are required to distinguish the type of smoke.

What is claimed is:

1. A fire alarm system comprising light emitting means for illuminating a smoke detection space, and light receiving means for receiving light scattered by smoke wherein the occurrence of a fire is detected by comparing the amount of the light received by said light receiving means to a predetermined reference value, said fire alarm system characterized in that:

said light emitting means emits plane-polarized light which is polarized parallel to a scattering plane as well as plane-polarized light which is polarized perpendicular to the scattering plane wherein said scattering plane is defined by the optical axis of said light emitting means and the axis of said light receiving means wherein both axes cross each other at a point in said smoke detection space;

said light receiving means receives light which is parallel polarized component to said scattering plane and light which is perpendicular polarized component to said scattering plane;

said fire alarm system further comprises:

photoelectric conversion means for detecting the amount of each polarized light received by said light receiving means;

calculation means for calculating the ratio of the amount between the parallel polarized competent to said scattering plane and the perpendicular polarized component to said scattering plane wherein the amount of the light polarized in each plane is obtained by said photoelectric conversion means and decision means which compares the ratio obtained by said calculation means to a reference value preset for each type of smoke whereby the judgement of whether there is a fire or not is performed based on said reference value for each type of smoke.

2. A fire alarm system according to claim 1, wherein:

said light emitting means comprises a first light emitting device and a second light emitting device;

said light receiving means comprises a first light receiving device and a second light receiving device;

said first light emitting device emits plane-polarized light which is polarized parallel to a first scattering plane wherein said first scattering plane is defined by the optical axis of said first light emitting device and the axis of said first light receiving device wherein both axes cross each other at a point in said smoke detection space;

said second light emitting means emits plane-polarized light which is polarized perpendicular to a second scattering plane wherein said second scattering plane is defined by the optical axis of said second light emitting device and the axis of said second light receiving device wherein both axes cross each other at a point in said smoke detection space;

said first light receiving device receives parallel polarized component to said first scattering plane;

said second light receiving device receives perpendicular polarized component to said second scattering plane;

said photoelectric conversion means detects the amounts of the light received by said first and second light receiving devices; and said calculation means calculates the ratio of the amount of the light received by said first light receiving device to that received by said second light receiving device wherein each amount of the light is obtained by said photoelectric conversion means.

3. A fire alarm system according to claim 1, wherein:

said light receiving means comprises a first light receiving device and a second light receiving device;

said light emitting means emits plane-polarized light which is polarized parallel to a first scattering plane wherein said first scattering plane is defined by the optical axis of said light emitting means and the axis of said first light receiving device wherein both axes cross each other at a point in said smoke detection space;

said first light receiving device receives parallel polarized component to said first scattering plane;

said second light receiving device receives perpendicular polarized component to a second scattering plane wherein said second scattering plane is defined by the optical axis of said light emitting means and the axis of said second light receiving device wherein both axes cross each other at a point in said smoke detection space;

said first scattering plane is perpendicular to said second scattering plane;

said photoelectric conversion means detects the amounts of the light received by said first and second light receiving devices; and said calculation means calculates the ratio of the amount of the light received by said first light receiving device to that received by said second light receiving device wherein each amount of the light is obtained by said photoelectric conversion means.

4. A fire alarm system according to claim 1, wherein:

said light emitting means comprises a first light emitting device and a second light emitting device which are lit alternately;

said first light emitting device emits plane-polarized light which is polarized parallel to a first scattering plane wherein said first scattering plane is defined by the optical axis of said first light emitting device and the axis of said light receiving means wherein both axes cross each other at a point in said smoke detection space;

said second light emitting device emits plane-polarized light which is polarized perpendicular to a second scattering plane wherein said second scattering plane is defined by the optical axis of said second light emitting device and the axis of said light receiving means wherein both axes cross each other at a point in said smoke detection space;

said light receiving means receives parallel polarized component to said first scattering plane;

said first scattering plane is perpendicular to said second scattering plane;

said photoelectric conversion means detects the amount of the light received by said light receiving means when said first or second light emitting device is lit; and said calculation means calculates the ratio of the amount of the light received when the said first light emitting device is lit to that received when said second light emitting device is lit wherein each amount of the light is obtained by said photoelectric conversion means.

5. A fire alarm system according to claim 1, wherein said light emitting means emits plane-polarized light, said fire alarm system further comprising:

driving means for rotating said light emitting means such that the polarization plane of said plane-polarized light becomes parallel or perpendicular to said scattering plane; and a polarizing filter disposed in front of said light receiving means wherein said polarizing filter is rotated in synchronization with said light emitting means such that said polarizing filter may be at the positions at which only the light which is polarized in the same plane as that of said plane-polarized light can pass through said polarizing filter;

wherein said photoelectric conversion means detects the amount of the light received by said light receiving means when said light emitting means comes at positions at which the polarization plane of the plane-polarized light emitted by said light emitting means becomes perpendicular or parallel to said scattering plane; and said calculation means calculates the ratio of the amount of the light received when the polarization plane of said plane-polarized light becomes perpendicular to said scattering plane to that received when The polarization plane of said plane-polarized light becomes parallel to said scattering plane wherein said amount of the light is obtained by said photoelectric conversion means.

6. A fire alarm system according to any claims 1 through 5, wherein the scattering angle is in the range from 60° to 140°.

7. A fire alarm system according to any claims 1 through 5, wherein the scattering angle is 90°.

8. A method of detecting a fire by using light emitting means for illuminating a smoke detection space, and light receiving means for receiving the light scattered by smoke wherein the occurrence of a fire is detected by comparing the amount of the light received by said light receiving means to a predetermined reference value, said method comprising the steps of:

emitting, from said light emitting means, plane-polarized light which is polarized parallel to a scattering plane as well as plane-polarized light which is polarized perpendicular to the scattering plane wherein said scattering plane is defined by the optical axis of said light emitting mean and the axis of said light receiving means wherein both axes cross each other at a point in said smoke detection space;

receiving, with said light receiving means, parallel polarized component to said scattering plane as well as light which is polarized perpendicular to said scattering plane;

detecting the amount of each plane-polarized light received by said light receiving means;

calculating the ratio of the amount of the parallel polarized component to said scattering plane to that perpendicular polarized component to said scattering plane; and comparing said ratio to a reference value preset for each type of smoke whereby the judgement of whether there is a fire or not is performed based on said reference value for each type of smoke.

9. A method of detecting a fire according to claim 6, wherein:

said light emitting means comprises a first light emitting device and a second light emitting device; and said light receiving means comprises a first light receiving device and a second light receiving device;

said method comprising the steps of:

emitting, from said first light emitting device, plane-polarized light which is polarized parallel to a first scattering plane wherein said first scattering plane is defined by the optical axis of said first light emitting device and the axis of said first light receiving device wherein both axes cross each other at a point in said smoke detection space;

emitting, from said second light emitting means, plane-polarized light which is polarized perpendicular to a second scattering plane wherein said second scattering plane is defined by the optical axis of said second light emitting device and the axis of said second light receiving device wherein both axes cross each other at a point in said smoke detection space;

receiving parallel polarized component to said first scattering plane by using said first light receiving device;

receiving perpendicular polarized component to said second scattering plane by using said second light receiving device;

detecting the amount of each plane-polarized light received by said first and second light receiving devices;

calculating the ratio of the amount of the light received by said first light receiving device to that received by said second light receiving device; and comparing said ratio to a reference value preset for each type of smoke whereby the judgement of whether there is a fire or not is performed based on said reference value for each type of smoke.

10. A method of detecting a fire according to claim 8, wherein said light emitting means comprises a first light emitting device and a second light emitting device; said method comprising the steps of:

emitting, from said light emitting means, plane-polarized light which is polarized parallel to a first scattering plane wherein said first scattering plane is defined by the optical axis of said light emitting means and the axis of said first light receiving device wherein both axes cross each other at a point in said smoke detection space;

receiving parallel polarized component to said first scattering plane by using said first light receiving device;

receiving, with said second light receiving device, perpendicular polarized component to a second scattering plane wherein said second scattering plane is defined by the optical axis of said light emitting means and the axis of said second light receiving device wherein both axes cross each other at a point in said smoke detection space;

said first scattering plane is perpendicular to said second scattering plane;

detecting the amount of each plane-polarized light received by said first and second light receiving devices;

calculating the ratio of the amount of the light received by said first light receiving device to that received by said second light receiving device; and comparing said ratio to a reference value preset for each type of smoke whereby the judgement of whether there is a fire or not is performed based on said reference value for each type of smoke.

11. A method of detecting a fire according to claim 8, wherein said light emitting means comprises a first light emitting device and a second light emitting device which are lit alternately; said method comprising the steps of:

emitting, from said first light emitting device, plane-polarized light which is polarized parallel to a first scattering plane wherein said first scattering plane is defined by the optical axis of said first light emitting device and the axis of said light receiving means wherein both axes cross each other at a point in said smoke detection space;

emitting, from said second light emitting device, plane-polarized light which is polarized perpendicular to a second scattering plane wherein said second scattering plane is defined by the optical axis of said second light emitting device and the axis of said light receiving means wherein both axes cross each other at a point in said smoke detection space;

receiving parallel polarized component to said first scattering plane by using said light receiving means;

said first scattering plane is perpendicular to said second scattering plane;

detecting the amount of the light received by said light receiving means when said first or second light emitting devices is lit;

calculating the ratio of the amount of the light received when the said first light emitting device is lit to that received when said second light emitting device is lit; and comparing said ratio to a reference value preset for each type of smoke whereby the judgement of whether there is a fire or not is performed based on said reference value for each type of smoke.

12. A method of detecting a fire according to claim 8, comprising the steps of:

emitting plane-polarized light from said light emitting means;

providing driving means for rotating said light emitting means such that the polarization direction of said plane-polarized light becomes parallel or perpendicular to said scattering plane;

providing a polarizing filter disposed in front of said light receiving means wherein said polarizing filter is rotated in synchronization with said light emitting means such that said polarizing filter may be at the positions at which only the light which is polarized in the same plane as that of said plane-polarized light can pass through said polarizing filter;

detecting the amount of the light received by said light receiving means when said light emitting means comes at positions at which the polarization plane of the plane-polarized light emitted by said light emitting means becomes perpendicular or parallel to said scattering plane;

calculating the ratio of the amount of the light received when the polarization plane of said plane-polarized light becomes perpendicular to said scattering plane to that received when the polarization plane of said plane-polarized light becomes parallel to said scattering plane; and comparing said ratio to a reference value preset for each type of smoke whereby the judgement of whether there is a fire or not is performed based on said reference value for each type of smoke.

13. A fire alarm system according to any claims 8 through 12, wherein the scattering angle is in the range from 60° to 140°.

14. A fire alarm system according to any claims 8 through 12, wherein the scattering angle is 90°.

* * * * *